US007017375B1

(12) United States Patent
Chen

(10) Patent No.: US 7,017,375 B1
(45) Date of Patent: Mar. 28, 2006

(54) FIBER BLOWING AND HEAT DISSIPATING SYSTEM OF SINGLE-SIDED CIRCULAR KNITTING MACHINE

(75) Inventor: Shih-Lung Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/198,319

(22) Filed: Aug. 8, 2005

(51) Int. Cl.
*D04B 35/32* (2006.01)

(52) U.S. Cl. ..... 66/168

(58) Field of Classification Search ..... 66/168, 66/8, 13; 15/301
See application file for complete search history.

(56) References Cited

U.S. PATENT DOCUMENTS

| | | | | |
|---|---|---|---|---|
| 4,691,536 | A * | 9/1987 | Yorisue et al. | 66/168 |
| 5,282,372 | A * | 2/1994 | Gutschmit | 66/168 |
| 5,408,851 | A * | 4/1995 | Tsuchiya | 66/168 |
| 5,509,281 | A * | 4/1996 | Tsay | 66/168 |
| 5,544,504 | A * | 8/1996 | Neher et al. | 66/168 |
| 6,370,923 | B1 * | 4/2002 | Chol | 66/168 |

FOREIGN PATENT DOCUMENTS

| | | |
|---|---|---|
| TW | 267459 A | 1/1996 |
| TW | 286689 A | 9/1996 |
| TW | 429974 A | 4/2001 |

* cited by examiner

*Primary Examiner*—Danny Worrell
(74) *Attorney, Agent, or Firm*—Birch, Stewart, Kolasch & Birch, LLP

(57) ABSTRACT

A fiber blowing and heat dissipating system of single-sided circular knitting machine includes a fixed rod, a revolving supply device, and a fiber blowing device, wherein the revolving supply device includes a fixed rod, a rotary air supply section, and a driving motor. The fixed axle has an air inlet at its top, and the rotary air supply section has an air passage interconnected with the air inlet and connected to the fiber blowing device, such that the driving motor is driven to rotate around the fixed axle to centralize the air flow to blow away the cotton fibers easily produced at a yarn passing eyelet of the yarn passing plate and the yarn feeding eyelet of a yarn feeding nozzle and a knitting needle. The invention also can lower the heat produced by the friction between the rotation of the needle cylinder and the knitting needle.

8 Claims, 8 Drawing Sheets

FIBER BLOWING AND HEAT DISSIPATING SYSTEM OF SINGLE-SIDED CIRCULAR KNITTING MACHINE

FIELD OF THE INVENTION

The present invention relates to a fiber blowing and heat dissipating system, and more particularly to a fiber blowing and heat dissipating system applicable to a circular knitting machine for knitting single-sided knitted cloth.

BACKGROUND OF THE INVENTION

To improve the smoothness of the knitting operation during a knitting process of a circular knitting machine, the cotton yarn must be tightly pulled, and the cotton yarns usually produce cotton fibers in the process of inputting, guiding, and feeding the cotton yarns. If these cotton fibers are not removed, each component of the circular knitting machine will get stuck easily, and that will affect the smoothness of the knitting operation and shorten the life of the circular knitting machine. Furthermore, defects will be produced if the cotton fibers and the cotton yarns are knitted together to produce a piece of cloth, and that will affect the quality of the cloth.

In view of the foregoing problems, many prior art mechanisms for clearing cotton fibers have been proposed, such as R.O.C. Patent Publication No. 286689 entitled "Dust disposal device of circular knitting machine", R.O.C. Patent Publication No. 267459 entitled "Fiber blowing device of circular knitting machine", and R.O.C. Patent Publication No. 429974 entitled "Improved fiber blowing device of circular knitting machine" etc, wherein "Dust disposal device of circular knitting machine" mainly discloses a dust disposal device driven by a crank rod mechanism to sway a fiber blowing fan up and down, and "Fiber blowing device of circular knitting machine" mainly discloses a device having a rotary nozzle, and the rotary nozzle has several nozzles capable of emitting air towards different tangential directions. When the air is emitted, the nozzle rotates automatically to produce a centralized airflow on the vertical lead surface of the circular knitting machine, and "Improved thread end removing vibratory pipe of knitting machine" mainly discloses a design of using pressurized air to go through a soft flexible tube and a thickness of the wall of the soft tube to improve the accuracy of guiding air to the target area.

It is worth to point out that most of the fiber blowing devices for the circular knitting machine blow at the yarn feeding position. However, the inventor of the present invention discovered that cotton fibers are produced easily at the positions of the yarn passing plate, yarn feeding nozzle, and knitting needle of the circular knitting machine, since the yarn passing plate and the yarn feeding nozzle have holes and openings for passing the cotton yarns in the knitting process. The cotton yarn will keep on rubbing the holes and openings of the yarn passing plate and the yarn feeding nozzle to produce cotton fibers, and the knitting needle produces cotton fibers easily during the processes of rotating and hooking the yarns. With long-time high-speed rotations, the knitting needle generally produces a high temperature. For present traditional fiber blowing devices, no measures for centralizing the airflow to blow fibers at the positions of easily producing cotton fibers and lower the temperature at the positions of producing heat are taken into consideration for the circular knitting machine. Thus, finding a way of effectively blowing away the cotton fibers and lowering the temperature for the applications of the present circular knitting machine demands immediate attentions and feasible solutions.

SUMMARY OF THE INVENTION

The primary objective of the present invention is to provide a fiber blowing and heat dissipating system of single-sided circular knitting machine that centralizes an airflow to blow cotton fibers away from a yarn passing eyelet of a yarn passing plate, a yarn feeding eyelet of yarn feeding nozzle, and a knitting needle of the circular knitting machine and to lower the temperature of the heat produced by the friction between the rotation of a needle cylinder and the knitting needle, and thus the invention can stabilize the smoothness of the knitting operation, maintain the life of the circular knitting machine, and assures the quality of knitting products.

To achieve the foregoing objective, the present invention provides a fiber blowing and heat dissipating system of single-sided circular knitting machine, comprising a fixed rod fixed onto the single-sided circular knitting machine; a revolving supply device having a fixed axle disposed at its center and coupled to the fixed rod, and the fixed axle including an air inlet and a conducting wire inlet electrically coupled to a conducting fixed ring, and the revolving supply device including a rotary air supply section and a driving motor that uses a conducting rod and a conducting wire to connect the conducting fixed ring, wherein the rotary air supply section includes an air passage interconnected with the air inlet, and the driving motor is driven to rotate around the fixed axle; and a fiber blowing device having a first fiber blowing pipe and a second fiber blowing, and an end of the first fiber blowing pipe being interconnected with the air passage, and the other end being coupled to a soft tube extended to a position proximate to the yarn passing plate, and the soft tube being capable of freely swaying to blow air after the first fiber blowing pipe is interconnected; and an end of the second fiber blowing pipe is interconnected to the air passage, and the other end is extended to a position proximate to the yarn feeding nozzle and the knitting needle, and the second fiber blowing pipe blows air after being interconnected.

Thereby, the soft tube is extended to a position proximate to the yarn passing plate to freely sway and blow air, and the second fiber blowing pipe is extended to a position proximate to the yarn feeding nozzle and the knitting needle to blow air, and being capable of centralizing an airflow to effectively blow away cotton fibers and dissipating heat for the yarn passing plate, the yarn feeding nozzle, and the knitting needle.

The technical contents of the present invention will now be described in more detail hereinafter with reference to the accompanying drawings that show various embodiments of the invention.

DETAILED DESCRIPTION OF THE PREFERRED EMBODIMENTS

Figure 1:
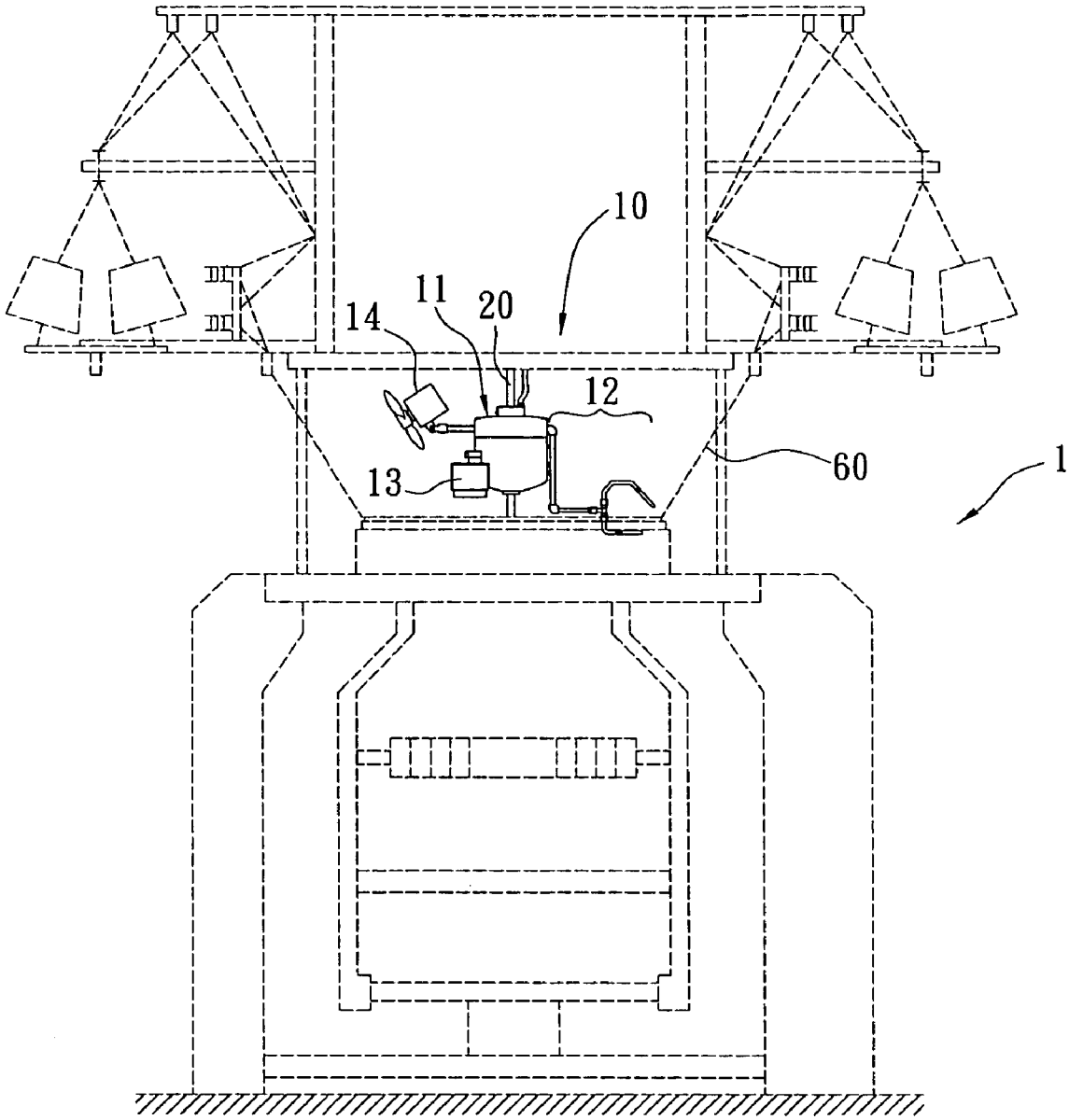
FIG. 1 is a schematic view of a fiber blowing and heat dissipating system being installed onto a single-sided circular knitting machine according to the present invention.
Figure 2:
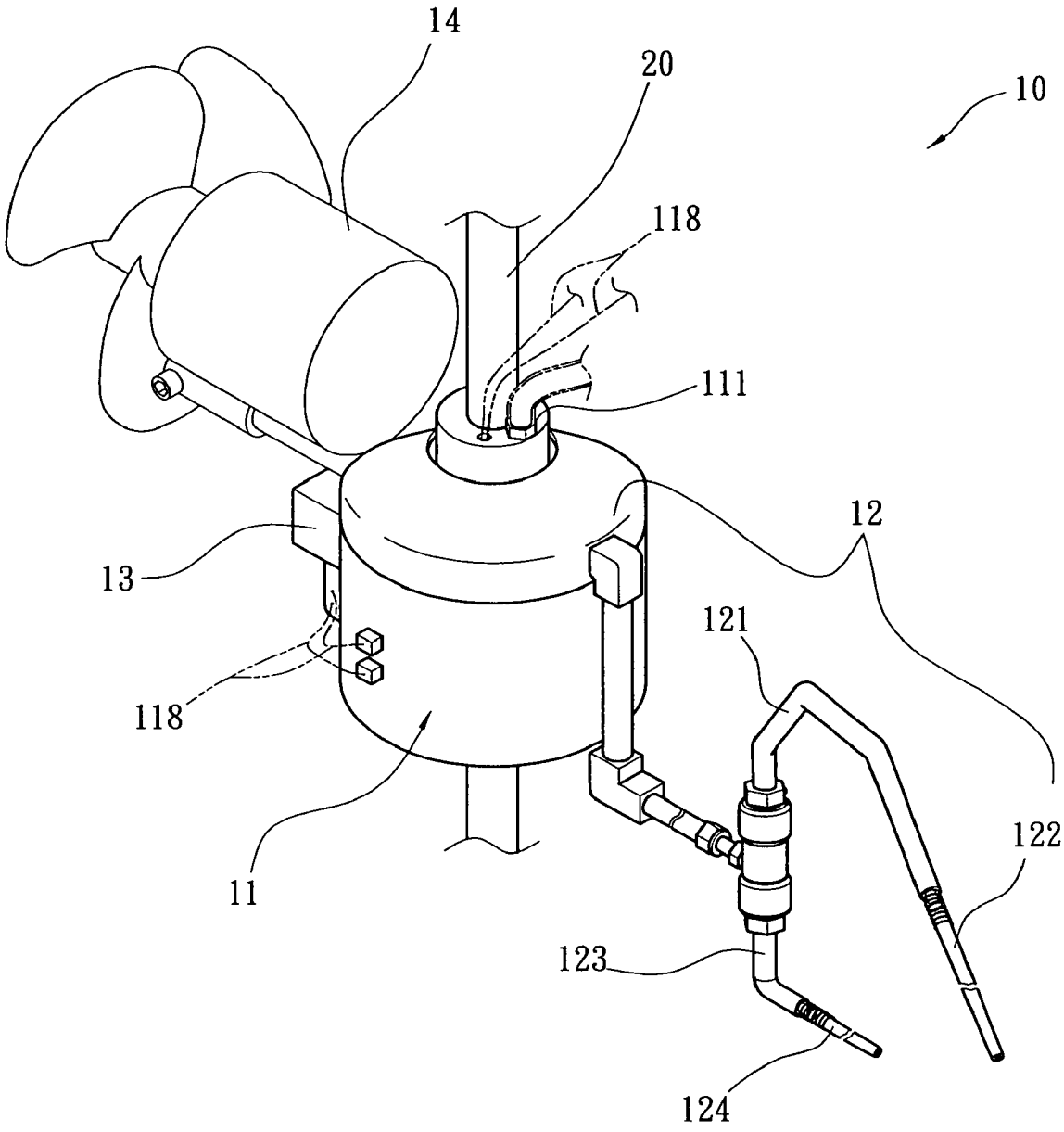
FIG. 2 is a perspective view of a single-sided circular knitting machine fiber blowing and heat dissipating system according to the present invention.
Figure 3:
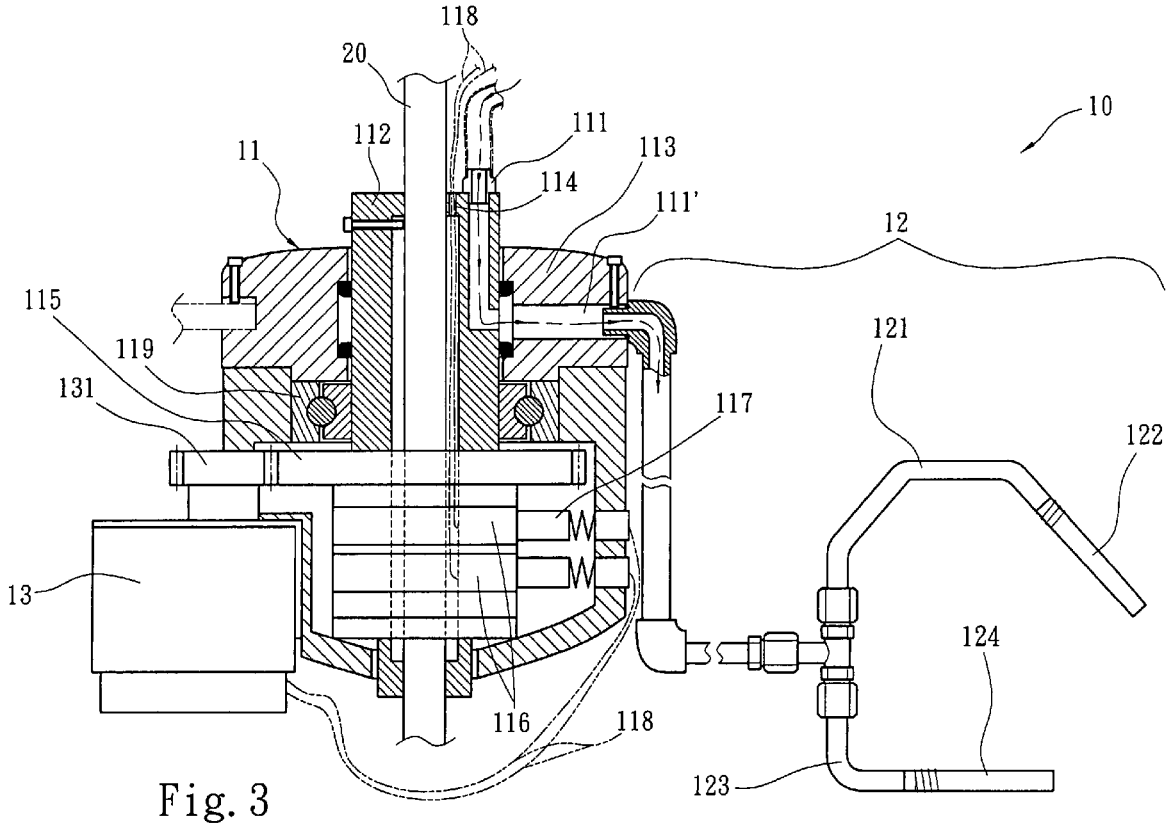
FIG. 3 is a cross-sectional view of a single-sided circular knitting machine fiber blowing and heat dissipating system according to the present invention.

The technical contents of the present invention will now be described in more detail hereinafter with reference to the accompanying drawings that show various embodiments of the invention.

Refer to FIGS. 1, 2, 3 and 6 respectively for the schematic view, the perspective view, the cross-sectional view, and the preferred embodiment of a fiber blowing and heat dissipating system of single-sided circular knitting machine according to the present invention. The present invention is particularly suitable for being used for a single-sided circular knitting machine 1. The single-sided circular knitting machine 1 comprises a plurality of yarn passing plates 30 for connecting cotton yarn 60, a plurality of yarn feeding nozzles 40, and a plurality of knitting needles 51 for knitting the cotton yarn 60, wherein the cotton yarn 60 is passed separately through yarn passing eyelets 31 of the yarn passing plates 30 and a yarn feeding eyelets 41 of the yarn feeding nozzles 40.

The fiber blowing and heat dissipating system 10 of the invention includes a fixed rod 20, a revolving supply device 11, and a fiber blowing device 12, wherein the fixed rod 20 is fixed onto the single-sided circular knitting machine 1; the revolving supply device 11 has a fixed axle 112 at its center and coupled to the fixed rod 20, and the fixed axle 112 has an air inlet 111 disposed thereon and coupled to an air supply (such as a compressor, which is not shown in the figure); and a conducting wire inlet 114 is connected to two conducting fixed rings 116, and a fixed gear 115 is disposed at the middle section of the fixed axle 112; and the revolving supply device 11 includes a rotary air supply section 113 and a driving motor 13 uses a conducting rod 117 and a conducting wire 118 to connect the conducting fixed ring 116, and the driving motor 13 has a rotary gear 131 and a fixed gear 115 engaged with each other. After the driving motor 13 is started, the rotary gear 131 and the fixed gear 115 are engaged, and a ball bearing 119 on the fixed axle 112 is connected to a rotary air supply section 113 to drive the rotary air supply section 113 to rotate around the fixed axle 112, and the rotary air supply section 113 includes an air passage 111' interconnected with the air inlet 111.

Figure 6:
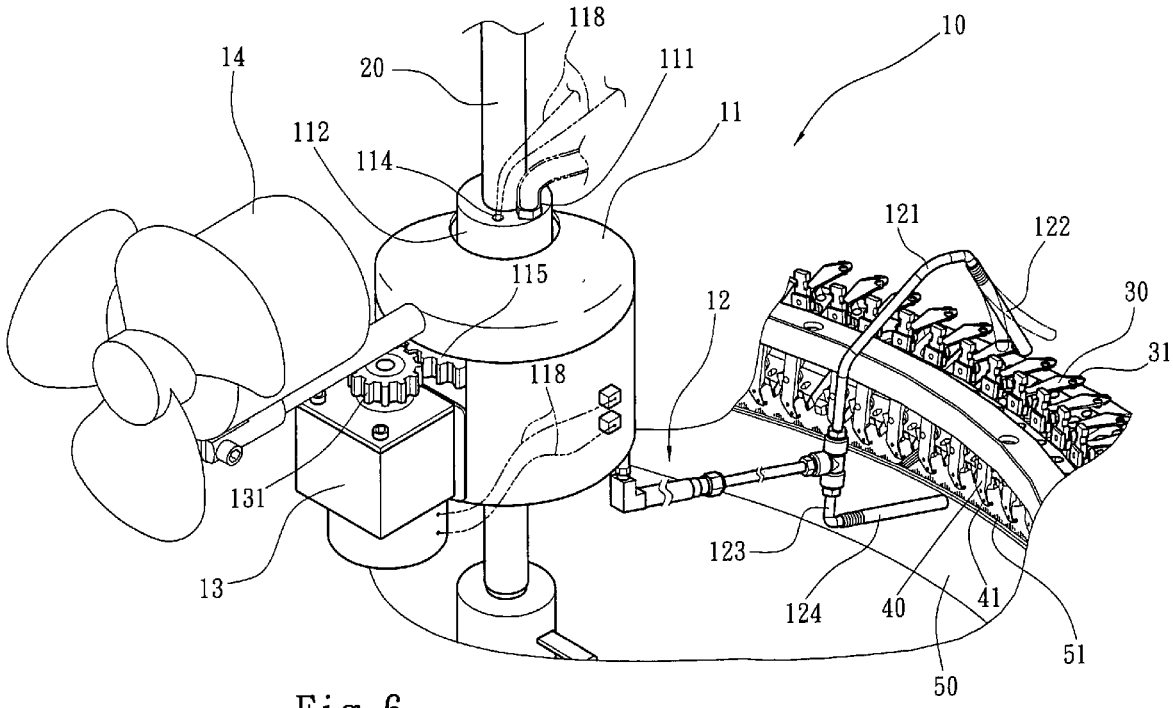
FIG. 6 is a schematic view of a single-sided circular knitting machine fiber blowing and heat dissipating system according to a preferred embodiment of the present invention.

The fiber blowing device 12 includes a first fiber blowing pipe 121 and a second fiber blowing pipe 123, wherein an end of the first fiber blowing pipe 121 is interconnected to the foregoing air passage 111', and the other end is connected to a soft tube 122 such as a rubber tube and extended to a position proximate to the yarn passing plate 30 as shown in FIG. 6. By the design of the thickness of a wall, the soft tube 122 can freely sway to blow air after the first fiber blowing pipe 121 is interconnected, and an end of the second fiber blowing pipe 123 is interconnected to a first fiber blowing pipe 121, and then interconnected to the foregoing air passage 111', and the other end is extended to a position proximate to the yarn feeding nozzle 40 and the knitting needle 51 as shown in FIG. 6. The second fiber blowing pipe 123 blows air after being interconnected. Of course, an end of the second fiber blowing pipe 123 proximate to the position of the yarn feeding nozzle 40 and the knitting needle 51 can be connected to a connecting pipe 124 (such as a rubber tube). Of course, the connecting pipe 124 can freely sway to blow air after the second fiber blowing pipe 123 is interconnected. Further, the revolving supply device 11 can go with at least one fan 14 to increase the area of blowing fibers and dissipating heat for a more significant effect.

Figures 4A, 4B:
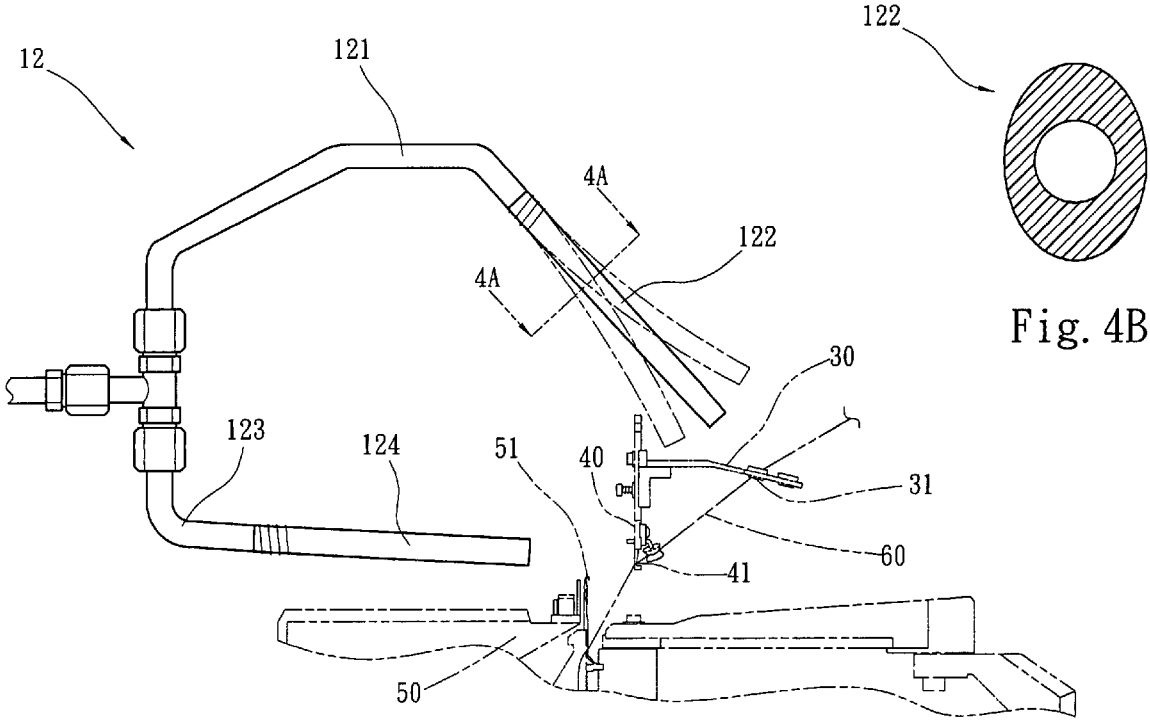
FIG. 4A is a schematic view of a section of a single-sided circular knitting machine fiber blowing and heat dissipating system according to the present invention.
FIG. 4B is a cross-sectional view of Section A—A as depicted in FIG. 4A.

Refer to FIGS. 4A and 4B for the schematic view of a section of a fiber blowing and heat dissipating system of single-sided circular knitting machine according to the present invention and the cross-sectional view of the soft pipe. With the design of a wall thickness as shown in FIG. 4B, the soft pipe 122 is extended proximate to the yarn passing plate 30 to be swayed freely to blow air, and an airflow is centralized at the swaying area to accurately aim at a yarn passing eyelet 31 of the yarn passing plate 30. The second fiber blowing pipe 123 is extended proximate to the yarn feeding nozzle 40 and the knitting needle 51 for blowing air. The airflow can be centralized at a yarn feeding eyelet 41 of the yarn feeding nozzle 40 and the knitting needle 51 effectively blows fibers and lower the heat produced by the friction between the rotation of a needle cylinder 50 and the knitting needle 51.

Figure 5A:
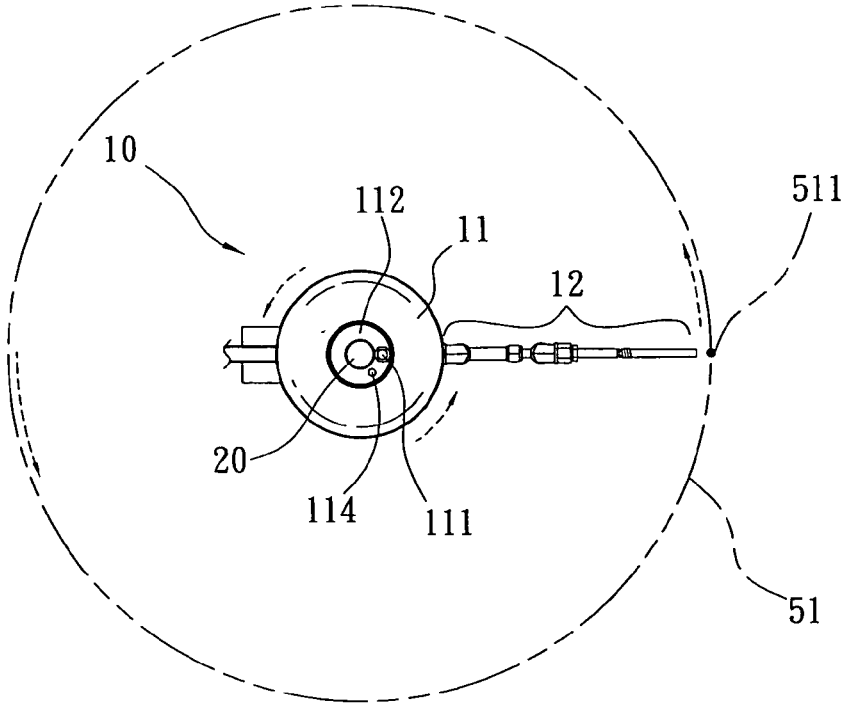
FIGS. 5A, 5B and 5C are schematic views of the rotary speeds of a single-sided circular knitting machine fiber blowing and heat dissipating system, the needle cylinder of the knitting needle according to the present invention.
Figure 5B:
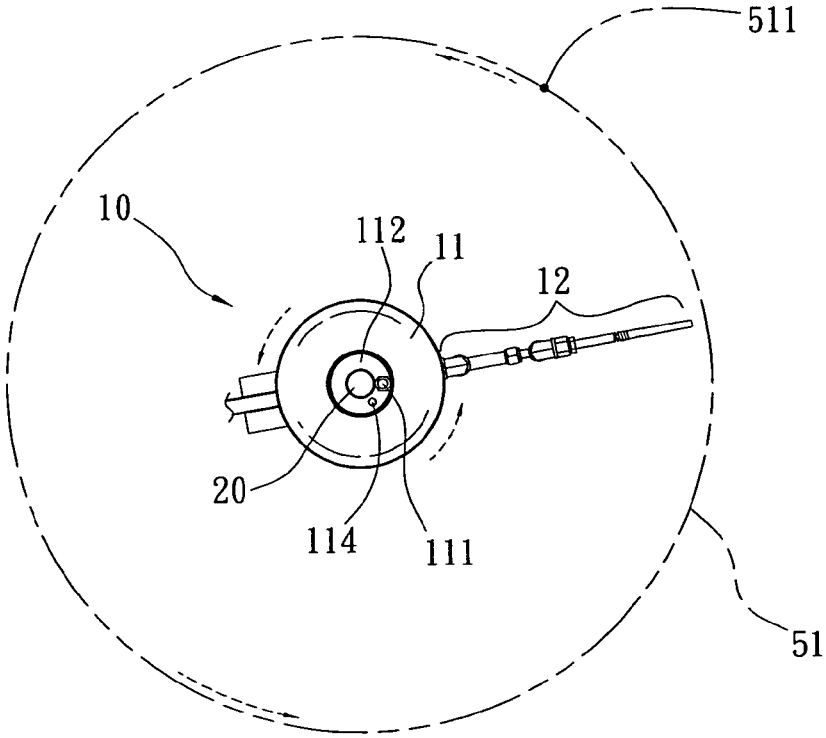
Figure 5C:
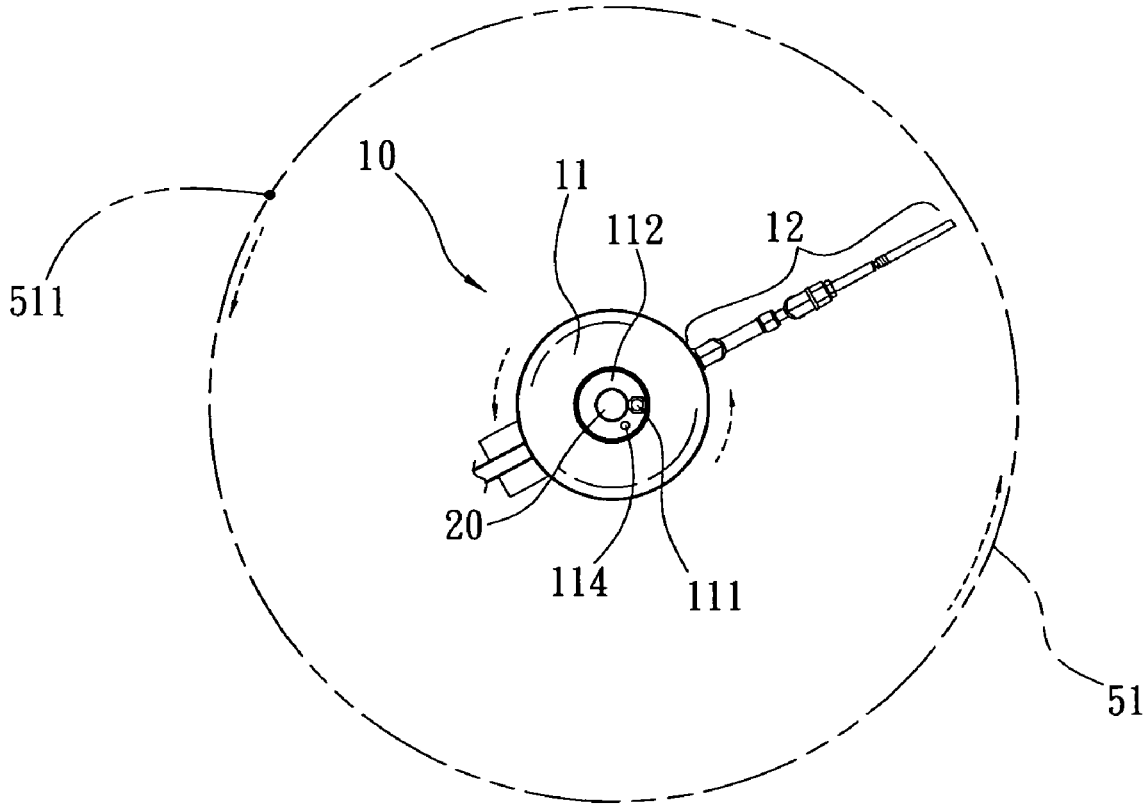

Refer to FIGS. 5A, 5B, and 5C for the schematic views of the rotary speeds of a fiber blowing and heat dissipating system of single-sided circular knitting machine, a needle cylinder, and a knitting needle according to the present invention. Since the needle cylinder 50 (not shown in the figure) is rotated in a high speed to drive the knitting needle 51 to move accordingly. If the speed of the revolving supply device 11 and the fiber blowing device 12 is the same as that of the knitting needle 51, the same knitting needle 51 is used from the beginning to the end. If we take a standard point 511 of the knitting needle 51 for example, when the knitting needle 51 rotates at a high speed, the rotary speed of the revolving supply device 11 and the fiber blowing device 12 is slow, and thus can effectively blow away the cotton fibers of the knitting needle 51 and lower the heat produced by the friction of the rotation of the knitting needle 51.

Figure 7:
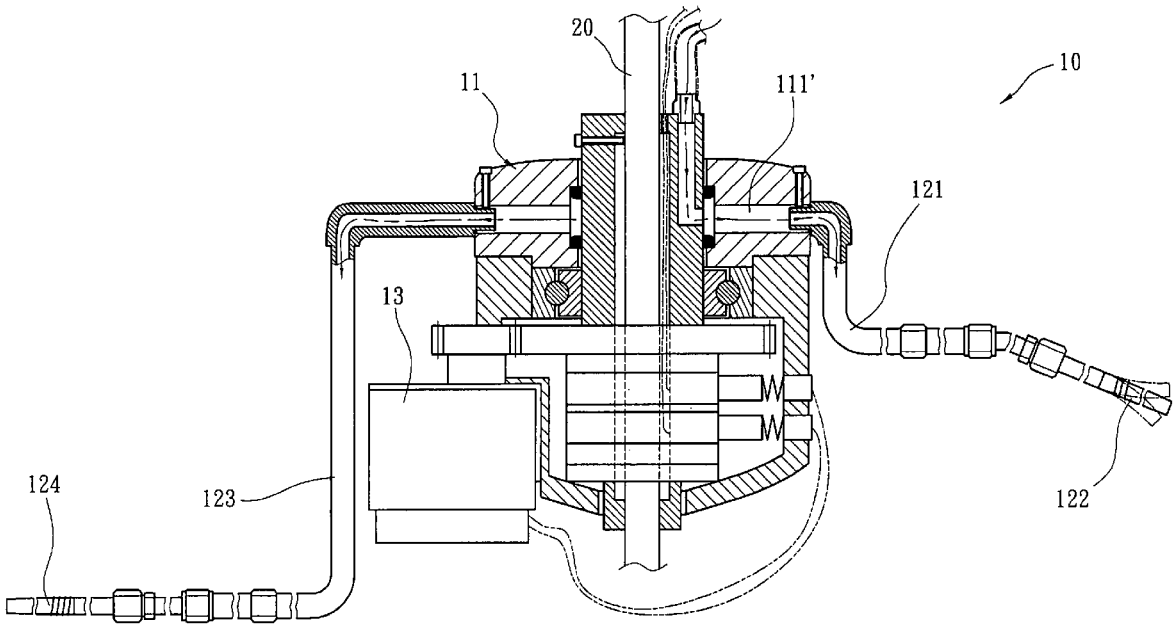
FIG. 7 is a schematic view of a single-sided circular knitting machine fiber blowing and heat dissipating system according to another preferred embodiment of the present invention.

Refer to FIG. 7 for the schematic view of a fiber blowing and heat dissipating system of single-sided circular knitting machine according to another preferred embodiment of the present invention. The fiber blowing and heat dissipating system 10 has a first fiber blowing pipe 121 and a second fiber blowing pipe 123, and the first fiber blowing pipe 121 and the second fiber blowing pipe 123 are separately interconnected to the foregoing air passage 111'. This design can achieve the same effect of the foregoing design. Similarly, the first fiber blowing pipe 121 can be connected to a soft tube 122, and the second fiber blowing pipe 123 can be connected to a connecting pipe 124 for its use.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fiber blowing and heat dissipating system of single-sided circular knitting machine, being applicable to a circular knitting machine for knitting a single-sided cloth, and said single-sided circular knitting machine comprising a plurality of yarn passing plates, a plurality of yarn feeding nozzles, and a plurality of knitting needles, and said fiber blowing and heat dissipating system comprising:

a fixed rod, fixed onto said single-sided circular knitting machine;

a revolving supply device, having a fixed axle disposed at its center and coupled to said fixed rod, and said fixed axle including an air inlet and a conducting wire inlet electrically coupled to a conducting fixed ring, and said revolving supply device including a rotary air supply section and a driving motor that uses a conducting rod and a conducting wire to connect said conducting fixed ring; wherein said rotary air supply section includes an air passage interconnected with said air inlet, and said driving motor is driven to rotate around said fixed axle; and a fiber blowing device, having a first fiber blowing pipe and a second fiber blowing, and an end of said first fiber blowing pipe being interconnected with said air passage, and the other end being coupled to a soft tube extended to a position proximate to said yarn passing plate, and said soft tube being capable of freely swaying to blow air after said first fiber blowing pipe is interconnected; and an end of said second fiber blowing pipe is interconnected to said air passage, and the other end is extended to a position proximate to said yarn feeding nozzle and said knitting needle, and said second fiber blowing pipe blows air after being interconnected;

thereby, said soft tube is extended to a position proximate to said yarn passing plate to freely sway and blow air, and said second fiber blowing pipe is extended to a position proximate to said yarn feeding nozzle and said knitting needle to blow air, and being capable of centralizing an airflow to effectively blow away cotton fibers and dissipating heat for said yarn passing plate, said yarn feeding nozzle, and said knitting needle.

2. The fiber blowing and heat dissipating system of single-sided circular knitting machine of claim 1, wherein said revolving supply device has a rotation speed smaller than the rotation speed of said plurality of knitting needles.

3. The fiber blowing and heat dissipating system of single-sided circular knitting machine of claim 1, wherein said first fiber blowing pipe is interconnected with an end of said second fiber blowing pipe and then interconnected with said air passage.

4. The fiber blowing and heat dissipating system of single-sided circular knitting machine of claim 1, comprising at least one first fiber blowing pipe and at least one second fiber blowing pipe.

5. The fiber blowing and heat dissipating system of single-sided circular knitting machine of claim 1, wherein said soft tube is a rubber tube.

6. The fiber blowing and heat dissipating system of single-sided circular knitting machine of claim 1, wherein said second fiber blowing pipe has an end interconnected to said air passage, and the other end coupled to a connecting pipe and extended to a position proximate to said yarn feeding nozzle and said knitting needle, and said second fiber blowing pipe being capable of freely swaying and blowing air after being interconnected.

7. The fiber blowing and heat dissipating system of single-sided circular knitting machine of claim 6, wherein said connecting pipe is a rubber tube.

8. The fiber blowing and heat dissipating system of single-sided circular knitting machine of claim 1, wherein said revolving supply device includes at least one fan disposed thereon and coupled to a conducting wire of said driving motor by said conducting wire.

* * * * *